US005339588A

United States Patent [19]

Ballstadt

[11] Patent Number: 5,339,588

[45] Date of Patent: Aug. 23, 1994

[54] EXTRUDED FRAME MOLDING FOR GLASS BLOCK STRUCTURES

[76] Inventor: George Ballstadt, 4850 Richmond Ave., Fremont, Calif. 94536

[21] Appl. No.: 933,401

[22] Filed: Aug. 21, 1992

Related U.S. Application Data

[63] Continuation-in-part of Ser. No. 502,848, Mar. 30, 1990.

[51] Int. Cl.[5] ..... E04B 2/00

[52] U.S. Cl. ..... 52/308; 52/62; 52/656.9

[58] Field of Search ..... 52/306, 307, 308, 61, 52/62, 656.9, 656.1, 656.2, 656.7, 656.4, 656.6, 656.6

[56] References Cited

U.S. PATENT DOCUMENTS 3,140,763 7/1964 Edelstein ..... 52/476

3,345,794 10/1967 Proud ..... 52/739

4,432,163 2/1984 Cassiere ..... 52/213

FOREIGN PATENT DOCUMENTS 1498010 1/1978 United Kingdom ..... 52/738

*Primary Examiner*—Michael Safavi

*Attorney, Agent, or Firm*—Bielen, Peterson & Lampe

[57] ABSTRACT

An extruded molding configured to frame glass masonary block for building structures, particularly wood frame structures, the molding having a substantially flat base portion on which the block is seated and raised side elements forming a channel, the molding having a topside of the base portion with a pair of bracket elements constructed to engage and retain the tab segment of a panel anchor and having an underside of the base portion with a weather flash and a nailing flange to prevent water seepage under the molding.

6 Claims, 2 Drawing Sheets

EXTRUDED FRAME MOLDING FOR GLASS BLOCK STRUCTURES

This application is a continuation in part of Ser. No. 07/502,848 filed Mar. 30, 1990.

BACKGROUND OF THE INVENTION

The invention relates to a specially configured, extruded molding for use with glass block building materials. This application is a continuation-in-part of my copending application, Ser. No. 07/502,848, filed Mar. 30, 1990 of the same title. This invention relates to my copending application Ser. No. 332,297, filed Mar. 31, 1989, now U.S. Pat. No. 5,014,471, issued, May 14, 1991. The embodiment disclosed herein comprises an alternate embodiment to those disclosed in the reference application and patent. In particular, the molding is used for glass block structures, especially where mortared glass block are set in wood frame structures and it is desired that the exterior wall surface be flush with exterior surface of the glass block structure.

The recent popularity of glass block for exterior walls, windows, room dividers and other more innovative structures has provided new challenges in integrating the masonry structures into existing or new buildings. Because of the increased use of glass block in home building, particular methods of adaptation must be employed since home building is largely of wood frame construction.

Since glass block structures are not load bearing and are extensively used for external windows and wall sections, the glass block structure must be encased by a means that prevents water intrusion. Prior to this invention, a simple sheet metal channel has been employed around the perimeter of the glass block structure as an interface between the masonry materials and conventional wood framing. While the channel isolates the glass block masonry structure from the wood framed it does not prevent water from seeping under the channel resulting in damage to the supporting wood structure.

Additionally, the increased use of glass block in interior design has resulted in structures that are innovative, such as glass wall partitions, low rising dividers, door transoms, and walk-way walls and the like. Frequently, the glass block wall structure must be incorporated into the frame construction building by a means that is both functional, attractive and structurally sound. Since most interior walls are constructed with two by four studs that are covered with sheet rock, an attractive trim that can be interposed between the glass block structure and the framing wall is desirable. In such situations, the weather flash also provides a flange for convenient seating and securing of the frame structure to the rough wood casement of the wall. The frame structure of this invention can be used with finish caps to finish exposed sides of the block structure and can also be use with anchor straps for securing the molding frame to the motared block panels.

The direct contact of wood materials to masonry structures is preferably to be avoided. Furthermore, a molding member that can accommodate glass block of the two different standard widths would be useful in both interior and exterior environments. The molding can also be used with new plastic block that is a light-weight counterfeit of glass block with particular application in light-weight room dividers.

These and other conditions in the construction of glass block structures have presented certain difficulties requiring more adequate solutions. Molding that is specially designed for masonry block would be useful to the construction industry. The extrusion moldings invented have been devised to solve the problems of incorporating glass block structures into new and existing buildings, particularly buildings that are of wood frame construction.

SUMMARY OF THE INVENTION

The uniquely configured extruded molding of this invention comprises a specialty trim for seating and framing glass masonry block in both interior and exterior environments.

The extruded molding devised when used in an exterior environment includes a combination weather flashing and nailing flange which prevents seepage of water behind the molding. Seepage of water invariably results in damage to the structure supporting or framing a glass block masonry structure. The molding devised both isolates the masonry structure from direct contact with the frame structure and secures the molding to the frame structure by a means that insures weather proofing.

The extruded molding when used for the interior environment provides a uniform wallboard trim and provides a convenient nailing flange for securing the frame structure and contained block structure in a rough wall frame.

The molding is useful for masonry buildings or wood building and is particularly designed as an attractive encasement trim where the trim serves a functional as well as ornamental purpose.

The extruded molding is preferably of an inexpensive and non-corrosive metal such as aluminum which may be finished with an anodized or coated surface as is customary for aluminum glazing extrusions. The molding preferably is fabricated in standard rigid lengths, for example, twenty feet, and has a uniform cross section along its length. The cross section for purposes of description is divided into multiple elements, but it is to be understood that the elements are integrally formed as a unitary structure during formation of the extrusion.

The molding is formed with a wide, flat, base element with outside edges having perpendicular, flat, side elements projecting from a seating surface on the side of the base element that abuts the glass block structure. The base element and side elements form a channel. The base element is sized to accommodate the width of a block when seated within the channel against an insulation pad of synthetic rubber, fiberglass or closed cell foam. Channels of different width accommodate block of the various standard widths. The base element in one embodiment includes a pair of bracket elements in the seating surface of the molding to engage and retain the tongue segment of an anchor strap. The anchor straps are particularly useful in retaining a prefabricated panel of blocks and the molding frame.

The opposite side of the base element has a backing surface that includes at least two screw slots to allow mitered ends of common molding to be fastened together by self-threading screws during assembly of an encasement frame. The screw slots and the bracket elements provide stiffening to the moldings and the underside support surface that interfaces the building structure by use of the molding, a pre-formed encasement can be constructed which forms a straight uniform border for the block structure and an accurate guide for block placement during assembly of the block wall structure. For smaller structures or structures using light-weight plastic block, the block can be assembled within the frame prior to placement of the frame in the building structure.

The extrusion of this invention provides the builder with the necessary materials for efficient and attractive encasement and trim of glass block masonry structures in both interior and exterior environments.

DETAILED DESCRIPTION OF THE PREFERRED EMBODIMENTS

Figure 1:
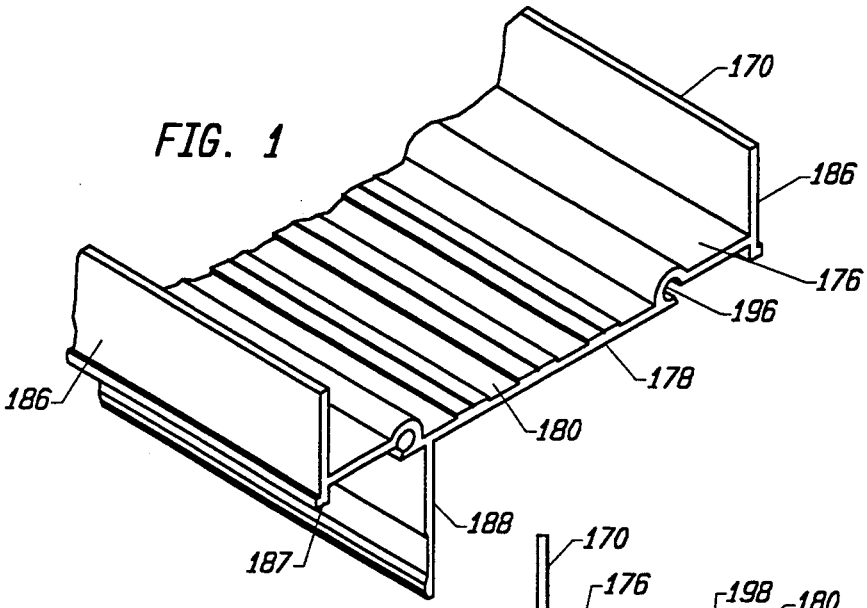
FIG. 1 is a perspective view of an end segment of an alternate configuration of the exterior molding of this invention.
Figure 2:
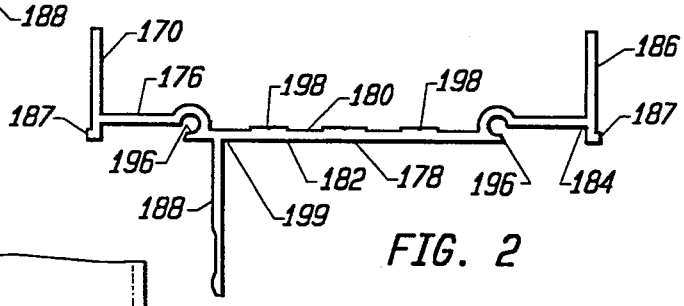
FIG. 2 is a cross sectional view of the molding of FIG. 1.
Figure 3:
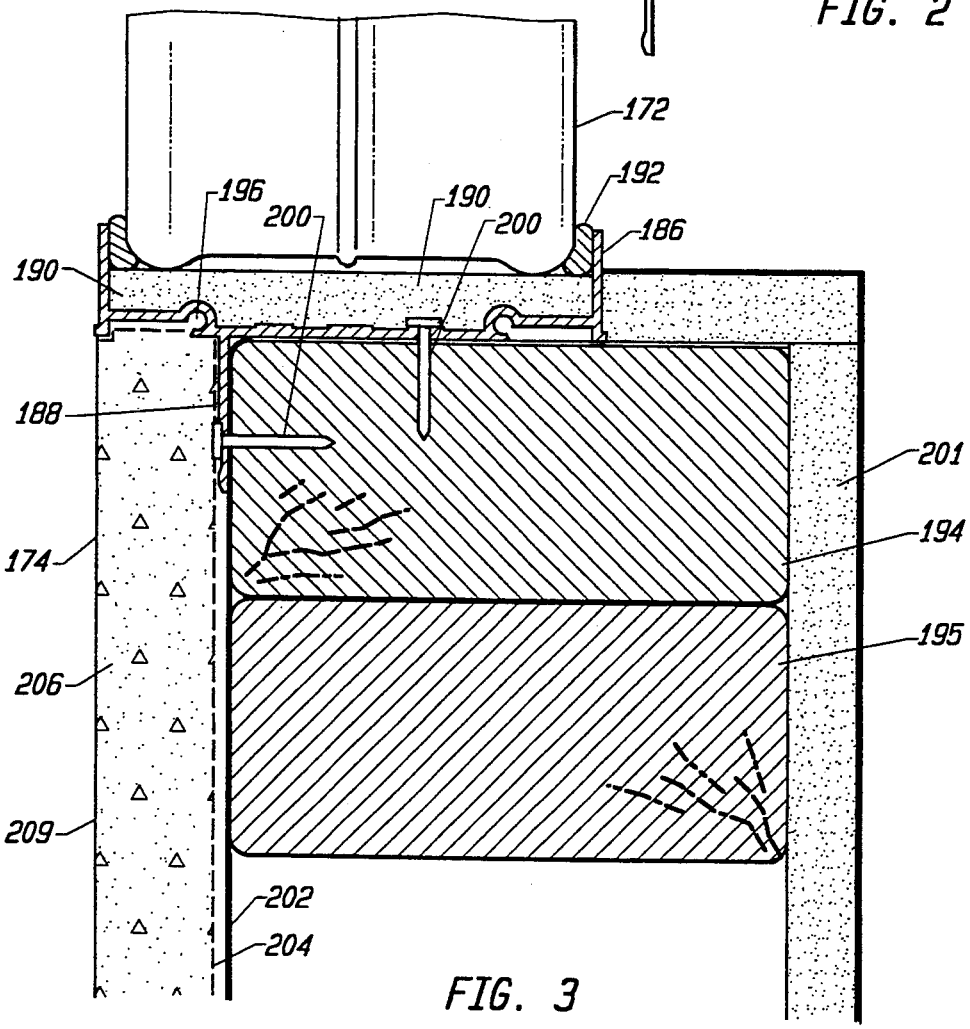
FIG. 3 is a cross sectional view of the molding of FIG. 1 in a typical building structure.

One preferred embodiment of the extruded molding of this invention is shown in FIGS. 1–3 and is designated by the reference numeral 170. This molding is designed for use in flush wall structures where it is desired to position glass or plastic block, such as the "thin-line" block 172 of FIG. 3, flush with the wall surface 174. The molding 172 comprises a channel structure 176 having a wide, substantially flat base element 178 with a top seating surface 180 and a bottom backing surface 182 with edges 184 having raised flat side elements 186, and a projecting finish bead 187. The channel structure has a flat flash member 188 projecting from the bottom backing surface 182 perpendicular to the base element 178. The side elements 186 and flash member 188 are platelike in construction, and are arranged in parallel planes to one another, and run the length of the molding.

As shown in FIG. 3, the block is seated between the side elements 186 on a filler base 190 that may be of an expansion composition such as a synthetic rubber mastic. This enables a block structure framed with the molding to have a different coefficient of thermal expansion than the preferred aluminum of the molding. The space between the block and the side elements 186 is filled with a conventional sealant bead 192 of a material such as butyl rubber, a synthetic rubber, that adheres well to glass and metal and provides an expansion seal when cured. The base element 178 seats on a cripple stud 194 forming part of the structural casement 195 into which a frame, formed of molding segments that are mitered and joined, is installed. The base element includes screw slots 196 for fastening mitered corners together. The screw slots 196 provide a screw receptacle means for conveniently interconnecting mitered ends of the extruded molding when forming a frame. The base element also includes guide grooves 198 for securing the molding to a structural casement using nails 200 and the flash member of the molding is also secured by nails 200 to the encasement. The flash member has a break-off notch 199 for removing the flash member when the molding is used without the flash member. Additionally, screws or other fasteners can be used.

The structural casement is covered on the inside by conventional wallboard 201 and on the outside with a vapor barrier 202, screen 204 and a stucco coating 206. Other facing material may of course be used. The setback of the flash member 188 from the edge 184 of the channel structure 176 at the exterior side of the wall 209 enables the exterior wall to be substantially flush with the glass block.

Figure 4:
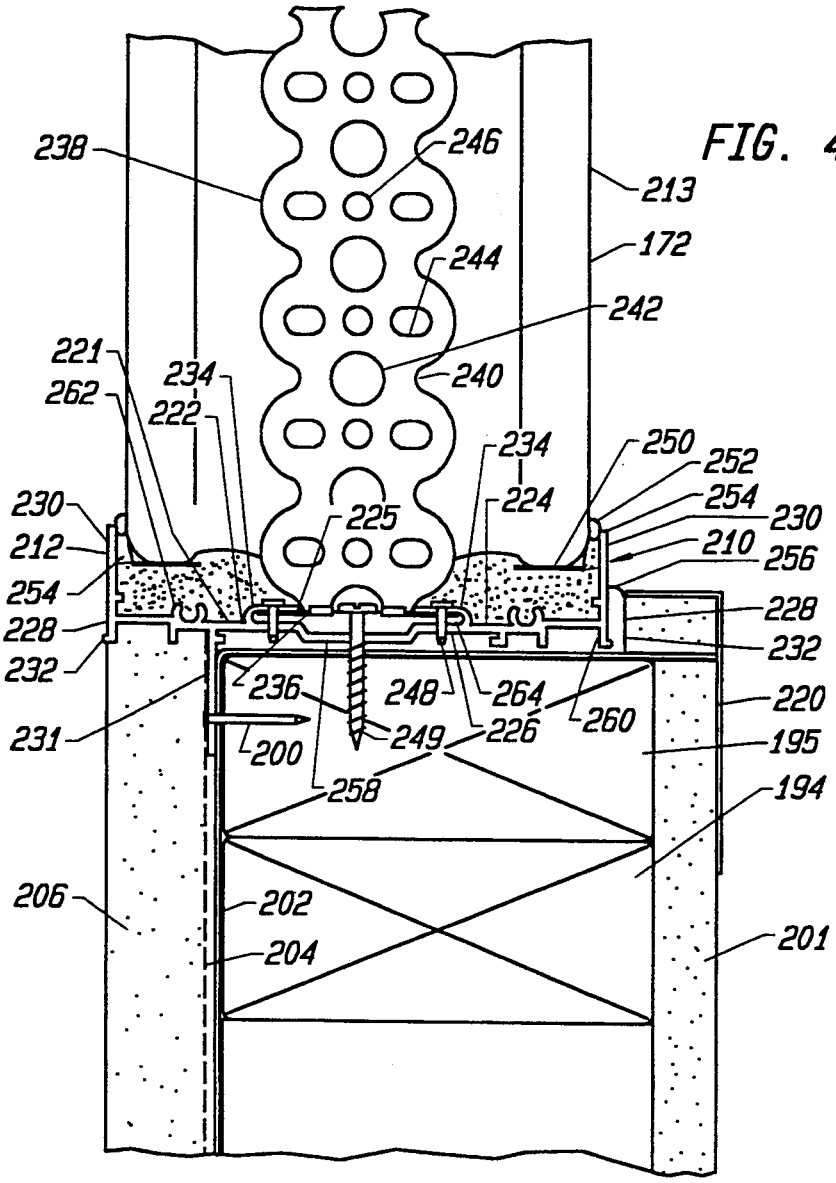
FIG. 4 is a cross sectional view of an end segment of an alternate configuration of the exterior molding of this invention.
Figure 6:
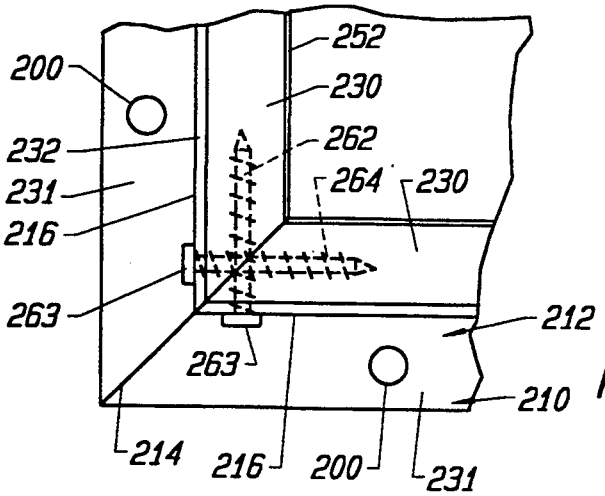
FIG. 6 is a detail view of a frame corner of two molding segments of the type of FIGS. 1 and 4.

Referring now to FIG. 4, an alternate embodiment of the extruded molding, designated generally in FIG. 4 as reference numeral 210, is shown mounted on the same type structural casement 195, into which a frame 212 (shown in part) is installed for framing a panel 213 of glass block 172 (one shown). A frame 212 is formed by mitering the ends 214 of molding segments 216 and joining the ends together with screws 263 as shown in the detail of FIG. 6.

The casement 195 includes a cripple stud 194 on which the molding 210 is seated. The casement 195 is finished with a vapor barrier 202, screen 204 and a stucco coating 206 on the outside and sheetrock wall 201 on the inside capped with a sheet metal corner strip 220.

The molding 210 is similarly constructed to the molding 170 of FIG. 1 and has a channel structure 221 with a wide, substantially flat base element 222 with a top seating surface 224 and a bottom backing surface 226 with outside edges 228 having raised flat side elements 230 with a projecting finish bead 232. The channel structure 221 has a flat flash member 230 projecting from the bottom backing surface 226 perpendicular to the base element 222. The flash member 230 is perpendicular to the base element 222 and parallel to the side elements 230 and forms a nailing flange to secure the molding 210 to the casement 195 with nails 200.

To insure that a block panel 213 is secured to a frame 212 fabricated from the molding 210, the base element 222 includes a pair of opposed brackets 234 in the top seating surface 224 forming a bracket slot 225 into which a bent end tab 236 of one or more panel straps 238 is installed.

Figure 5:
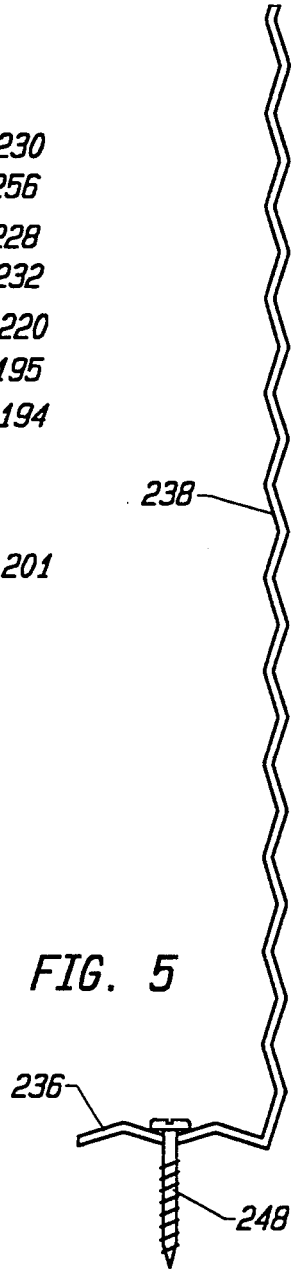
FIG. 5 is a partial side elevational view of a typical panel anchor bent for installation in the molding of FIG. 4.

Each panel strap 238 is preferably stamped from 20 gage, galvanized steel sheet and has a repetitive, hourglass configuration. This configuration enables the strap to be bent at a constriction 240 to form the end tab 236 that can be placed between the two brackets 234 and twisted 90° to the locking position shown in FIG. 4. Once in the slot, the panel strap 238 can be slid into position against the side of a block 172 before the next adjacent block is mortared in place. The strap 238 has a corrugated profile as shown in FIG. 5 and includes a series of holes 242, 244, and 246 allowing flow-through of mortar to improve the anchoring effect with the holes 244 and 246, also providing the optional means for securing the strap 238 to the molding by short screws 248 through the brackets 234 or long screws 249 through the base element 222 into the casement 195 for additionally securing the molding to the casement structure.

Straps 238 are generally used between every other block and are approximately a foot in length. Customerily, the integrity of the remaining block panel, displaced from the frame is provided by reinforcing wire in track-like segments placed between motared block.

The blocks are seated on an elastomer pad 250 and sealed with a sealant bead 252 over a glazing tap 254. The molding 212 is similarly sealed with a sealant bead 256 on the juncture with the corner finish strip 220 as shown.

The base element 222 is preferably configured with a foot 258 between brackets 234 on the bottom backing surface 226 with additional support toes 260 to elevate the brackets 234 and screw slots 262 such that mitered ends will provide enough bite for interconnecting screws threaded into the screw slots 262 and into the screw slot 264 formed by the bracket 234, where additional fastening is required, as shown in dotted line in FIG. 6.

The block panel can either be prefabricated with the frame formed from molding segments and installed as a unit in the building structure casement, or, the frame can be installed in the casement with block set on site.

The molding member is suited for use in interior structures as well as exterior structures and is ideal for use with new clear block fabricated from plastic compositions for light-weight structures such as room dividers in homes and offices.

The various moldings shown and described can be used in a variety of different structures which incorporate the use of glass building block. The example of typical structures shown herein is not intended to limit the types of block structure that can be constructed for advantageous incorporation of the moldings described.

While, in the foregoing, embodiments of the present invention have been set forth in considerable detail for the purposes of making a complete disclosure of the invention, it may be apparent to those of skill in the art that numerous changes may be made in such detail without departing from the spirit and principles of the invention.

What is claimed is:

1. An extruded molding adapted to form a perimeter frame around wall structures of glass masonary block, in combination with a flat anchor strap having a bent tab end, the anchor strap being used for anchoring mortared block to this molding, the molding comprising a unitary, elongated extrusion formed with a wide flat base element having a seating side and a backing side, the base element having further, outside edges with flat side elements projecting from the seating side at the outside edges of the base element, perpendicular to the base element, wherein a single channel is formed in which a glass block structure having a standard width is adapted to be seated, wherein the base element has a flat flash means for preventing seepage of water behind the molding and for securing the molding to a building structure having an exterior facing material with a predefined thickness, wherein the flash means comprises a nailing flange arranged perpendicular to the base element projecting from the backing side of the base element, the nailing flange being arrangeable against a frame member of a building structure for attachment thereto by securing means when the molding is supported against the building structure, the nailing flange being displaced a distance from one of the side elements wherein the facing material when applied over the nailing flange is substantially flush with the side element, wherein the base element includes screw receptacle means for interconnecting mitered ends of the extruded molding in forming a molding frame, and wherein the base element has an anchor strap retaining means engaging and retaining the flat anchor strap, wherein the anchor strap retaining means comprises a pair of opposed, spaced bracket elements in the seating side of the base element wherein a slot is formed that engages the bent tab end of the anchor strap.

2. The extruded molding of claim 1 wherein the side elements have a portion of the side element projecting from the backing side of the base element with an outwardly projecting finish bead proximate the base element for finishing wall structures.

3. An extruded molding adapted to form a perimeter frame around wall structures of glass masonry block, the molding comprising a unitary, elongated extrusion formed with a wide flat base element having a seating side and a backing side, the base element having further, outside edges with flat side elements projecting from the seating side at the outside edges of the base element, perpendicular to the base element, wherein a single channel is formed in which a glass block structure having a standard width is adapted to be seated, wherein the base element has a panel strap retaining means for engaging and retaining a flat anchor strap used for anchoring mortared block to the molding, wherein the strap retaining means comprises a pair of opposed, spaced bracket elements in the seating side of the base element wherein a slot is formed, the molding being combined with a retaining strap having a bent tab end installed in the slot and retained by the bracket elements.

4. The molding of claim 3 wherein the base element has a flat flash means for preventing seepage of water behind the molding and for securing the molding to a building structure, wherein the flash means comprises a nailing flange arranged perpendicular to the base element projecting from the backing side of the base element, the nailing flange being arrangeable against a frame member of a building structure for attachment thereto by securing means when the molding is supported against the building structure.

5. The molding of claim 4 wherein the base element includes a screw receptacle means for interconnecting mitered ends of the extruded molding in forming a frame molding.

6. The molding of claim 5 wherein the panel strap retaining means form the screw receptacle means.

* * * * *